United States Patent [19]

Horiuchi

[11] Patent Number: 4,886,952

[45] Date of Patent: Dec. 12, 1989

[54] POWER SOURCE DEVICE FOR HIGH-FREQUENCY INDUCTION HEATING

[76] Inventor: Yasushi Horiuchi, No. 11-10, Kamiyouga 3-chome, Setagaya-ku, Tokyo, Japan

[21] Appl. No.: 203,089

[22] Filed: Jun. 7, 1988

[30] Foreign Application Priority Data

Jun. 10, 1987 [JP] Japan ..... 62-144499

[51] Int. Cl.[4] ..... H05B 6/06

[52] U.S. Cl. ..... 219/10.77; 219/10.75; 323/210; 323/255; 363/173

[58] Field of Search ..... 219/10.77, 10.75, 10.491; 323/209, 210, 211, 255, 256, 257, 258; 363/170, 171, 173

[56] References Cited

U.S. PATENT DOCUMENTS

| | | | |
|---|---|---|---|
| 2,366,678 | 1/1945 | St. Palley | 323/209 |
| 2,366,981 | 1/1945 | Paddle et al. | 363/173 |
| 3,053,920 | 9/1962 | Seitz | 323/209 X |
| 3,391,329 | 7/1968 | Meyer | 219/10.77 X |
| 3,419,792 | 12/1968 | Kasper et al. | 219/10.77 X |
| 4,114,010 | 9/1978 | Lewis | 219/10.77 X |
| 4,549,056 | 10/1985 | Okatsuka et al. | 219/10.77 |
| 4,755,648 | 7/1988 | Sawa | 219/10.77 |

FOREIGN PATENT DOCUMENTS

| | | |
|---|---|---|
| 51-111937 | 10/1976 | Japan . |
| 53-41839 | 4/1978 | Japan . |
| 59-44787 | 3/1984 | Japan . |
| 60-162728 | 8/1985 | Japan . |
| 61-106724 | 5/1986 | Japan . |
| 62-139289 | 6/1987 | Japan . |
| 62-149809 | 7/1987 | Japan . |

*Primary Examiner*—Philip H. Leung

*Attorney, Agent, or Firm*—Fleit, Jacobson, Cohn, Price, Holman & Stern

[57] ABSTRACT

A power source device for high-frequency induction heating is disclosed. In this power source device, a plurality of high-frequency electric powers of different frequencies are supplied to the heating coil of a high-frequency induction heating appartus successively and repeatedly in time-division fashion at a very short period, to create a heating situation similar to multiple-frequency simultaneous heating, whereby the uniform quenching of an object to-be-treated having a complicated shape can be realized.

2 Claims, 1 Drawing Sheet

POWER SOURCE DEVICE FOR HIGH-FREQUENCY INDUCTION HEATING

BACKGROUND OF THE INVENTION

1. Field of the Invention

The present invention relates to a power source device for high-frequency induction heating which is utilized for the heat treatment of a metallic object to-be-treated such as the surface quenching of a gear, a screw or the like.

2. Description of the Prior Art

Heretofore, for the surface quenching of a steel product, high-frequency induction heating has been practised for long by exploiting the phenomenon that a high-frequency current induced in the object to-be-treated by high-frequency electric power concentrates in the part of the object to-be-treated close to the outer surface thereof owing to the skin effect. However, in the induction heat treatment of the object to-be-treated having an uneven shape, for example, a gear or a screw, it is impossible with the high-frequency electric power of single frequency to homogeneously heat the convex part and concave part of the object to-be-treated and to attain a uniform depth of surface hardening over the whole object.

In recent years, therefore, a 2-frequency high-frequency heating method has been developed and performed as an induction heating method for the surface quenching of a gear, a screw or the like. First, a high-frequency current at a comparatively low frequency $f_1$ is supplied to the heating coil of an induction heating apparatus so as to heat the concave part of the object to-be-treated, and when the temperature of the concave part has reached a predetermined temperature, the supply of the high-frequency current to the heating coil is once interrupted to stop the heating. Subsequently, a high-frequency current at a comparatively high frequency $f_2$ is supplied to the heating coil so as to heat the convex part of the object to-be-treated, and when the surface temperature of the whole object to-be-treated has reached a desired quenching value, the supply of the high-frequency current to the heating coil is stopped, and the object to-be-treated is rapidly cooled. Thus, the object is quenched.

In this regard, for the purpose of performing a quenching treatment of high quality, it is necessary to generate a desired uniform surface temperature over the whole object to-be-treated. In the 2-frequency high-frequency heating method of the prior art stated above, the timing of frequency switching for generating the desired uniform surface temperature is very important, and frequency switching conditions for the appropriate heat treatment need to be established beforehand by repeatedly conducting preparatory tests. Therefore, the productivity of the method is low. Moreover, the method involves the problem concerning control that, in a case where the timing of the frequency switching has been missed, no adjustment is possible. A further disadvantage is that two high-frequency power sources of the different frequencies are required for supplying the heating current to the heating coil.

Therefore, an object of the present invention is to provide a power source device for high-frequency induction heating which can eliminate the above mentioned disadvantages of the conventional methods.

SUMMARY OF THE INVENTION

According to the present invention, there is provided a power source device for high-frequency induction heating characterized in that a primary winding of a matching transformer by which a heating coil of an induction heating apparatus for heat-treating a metallic object to-be-treated is coupled to a high-frequency power source is provided with a plurality of taps each having a selected number of turns so as to permit the tapped portions of said primary winding to always impedance-match with a secondary winding of said matching transformer and said heating coil connected thereto at a plurality of frequencies suitable for a size, shape and state of the object to-be-treated; that said primary winding with said plurality of taps and a plurality of capacitors are combined to form a plurality of tank circuits whose natural frequencies are said plurality of frequencies, respectively, and to construct the plural-frequency self-excited high-frequency power source whose oscillation circuits are said respective tank circuits; and that in order to apply electric powers of said plurality of frequencies to the object to-be-treated successively and repeatedly in time-division fashion, high-speed switching means is provided for switching connections of said plurality of tank circuits to said self-excited high-frequency power source repeatedly and successively within a short time interval which corresponds to a desired heat treatment cycle.

The present invention will now be described in further detail with regard to preferred embodiments as illustrated in the accompanying drawings.

DESCRIPTION OF THE PREFERRED EMBODIMENTS

Figure 1:
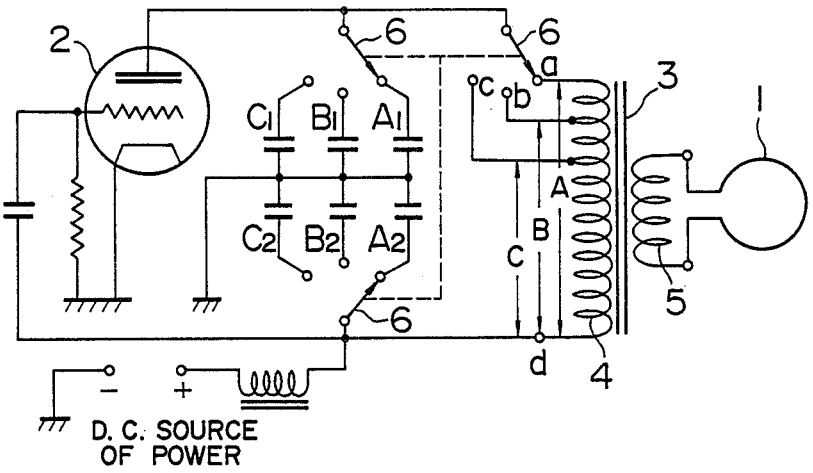
FIG. 1 of the accompanying drawings is a diagram schematically showing an embodiment of a power source device for high-frequency induction heating according to the present invention in which a vacuum-tube high-frequency oscillator is used as a self-excited high-frequency power source.

Referring now to FIG. 1, there is schematically shown one embodiment of the power source device of the present invention for high-frequency induction heating in which a vaccum-tube high-frequency oscillator is used as a self-excited high-frequency power source for feeding the heating coil of a heating induction apparatus with high-frequency electric power.

In this power source device, the primary winding 4 of a matching transformer 3 for coupling the heating coil 1 to the vacuum-tube high-frequency oscillator 2 is provided with a plurality of taps, for example, three taps a, b and c as shown in the figure. The winding portions (hereinbelow, termed the "section windings A, B and C") of the primary winding 4 between the corresponding taps a, b and c and the opposite terminal thereof have their impedances selected so as to respectively match with the impedances of the secondary winding 5 of the matching transformer 3 and the heating coil 1 connected to this secondary winding (the heating coil set on an object to-be-treated) at three frequencies $f_1$, $f_2$ and $f_3$ which are desired to be utilized in, for example, a heat treatment for the surface quenching of a gear being the object to-be-treated. In addition, the section windings A, B and C of the primary winding 4 are respectively combined with a plurality of capacitors $A_1$, $A_2$; $B_1$, $B_2$; and $C_1$, $C_2$ so as to form tank circuits $A$-$A_1$-$A_2$, $B$-$B_1$-$B_2$, $C$-$C_1$-$C_2$ whose natural frequencies are the frequencies $f_1$, $f_2$, and $f_3$, respectively. In order to switchingly use these tank circuits as the tuned oscillation circuits of the vacuum tube oscillator 2, the respective tank circuits $A$-$A_1$-$A_2$, $B$-$B_1$-$B_2$ and $C$-$C_1$-$C_2$ are repeatedly and successively switched and connected to the vacuum tube oscillator 2 proper by appropriate high-speed switching means 6 within a short time interval which corresponds to a desired heat treatment cycle for the gear being the object to-be-treated. Thus, high-frequency powers at the frequencies $f_1$, $f_2$ and $f_3$ are generated successively and repeatedly in time-division fashion by the high-frequency oscillator 2, and they are supplied to the heating coil 1 of the induction heating apparatus through the secondary winding 5 of the matching transformer 3. Then, the gear being the object to-be-treated is continuously heated by the high-frequency powers having the different frequencies $f_1$, $f_2$ and $f_3$, thereby making it possible to homogeneously heat the whole gear and to perform the surface quenching with a uniform hardening depth over the entire surface of the gear.

In this case of the multiple high-frequency induction heating based on the switching of the high-frequency electric powers having the different frequencies, unless the difference of the frequencies of the high-frequency electric powers used is large to some extent, the effect of the multiple high-frequency heating does not appear. Therefore, the values of the frequencies $f_1$, $f_2$ anf $f_3$ to be used should desirably be selected at, for example, 1 kHz, 10 kHz and 100 kHz, respectively. The switching period t of all of the frequencies $f_1$, $f_2$ and $f_3$ is set at, for example, about 0.5 second to 1.0 second.

The heat treatment cycle of the object to-be-treated greatly changes depending upon the size and shape of the object. By way of example, in a case where the object to-be-treated is a gear, the heat treatment cycle is on the order of several seconds for a gear of small module, and it sometimes exceeds several minutes for a gear of large module. Therefore, the number of times which the frequency switching periods are repeated within the heat treatment cycle is as slight as several times for the gear of small module, whereas it reaches several hundred times for the gear of large module.

As regards the number of the high-frequency electric powers to be used, when the three high-frequency electric powers having the frequency values of 1 kHz, 10 kHz and 100 kHz as mentioned above are switched and used at the switching periods as mentioned above by way of example, the intended uniform heating effect can be satisfactorily attained even for the object to-be-treated having a very rugged shape, such as the gear. On the other hand, even when the number of the high-frequency electric powers to be used is increased to be four or larger, merely the structural complication of the device, the troublesome operations thereof and a rise in the manufacturing cost thereof are incurred, and an enhanced heating effect cannot be expected considerably. Therefore, it is usually desireable to use two or three high-frequency electric powers.

As the high-speed switching means 6 for switchingly connecting the respective tank circuits $A$-$A_1$-$A_2$, $B$-$B_1$-$B_2$ and $C$-$C_1$-$C_2$ to the high-frequency oscillator 2 proper, it is possible to use any desired suitable known switch device, for example, a relay switch device, a rotary mechanical switch device, a thyristor switch device, a transistor switch device, or the like. In switching of high-frequency electric powers, it is preferable to effect the switching when the electric current is zero.

In switching and connecting the respective tank circuits to the high-frequency oscillator 2 proper, when the tank circuit including an inductance and a capacitance has been opened, there is the possibility that an undesirable situation such as the stop of the oscillation, the occurrence of an abnormal voltage or the striking of an electric arc will arise. It is therefore desirable to connect resistors within the tank circuits and to switch the tank circuits with the occurrence of any different voltage suppressed. In this case, the switching points of time of the oscillation frequencies are determined by the resistances of the resistors.

Figure 2:
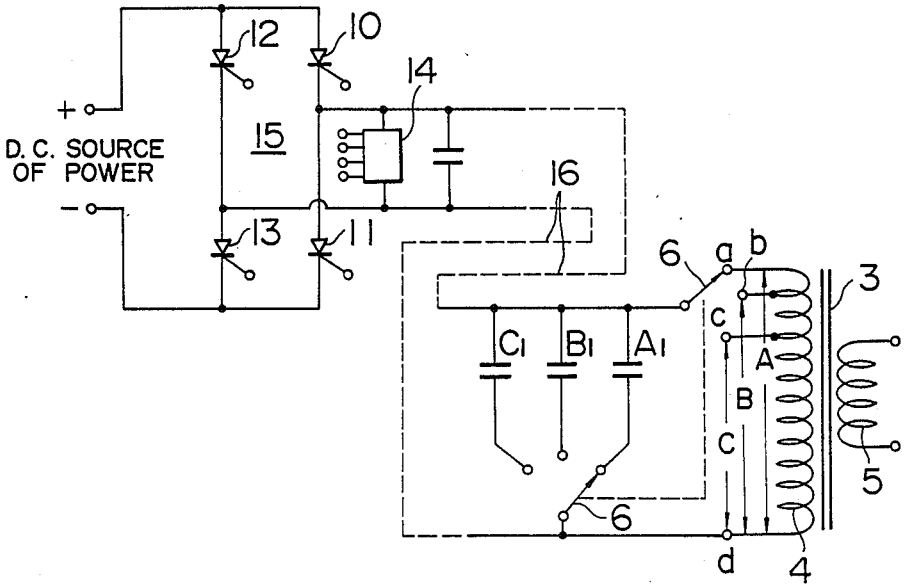
FIG. 2 is a diagram schematically showing another embodiment of a power source device for high-frequency induction heating according to the present invention in which a thyristor high-frequency generator is used as a self-excited high-frequency power source.

In FIG. 2 there is schematically shown another embodiment of the power source device of the present invention for high-frequency induction heating. In this embodiment, a thyristor high-frequency generator 15 constructed of four thyristors (SCRs) 10, 11, 12 and 13 and a trigger circuit 14 is used as a self-excited high-frequency power source. Just as in the embodiment shown in FIG. 1, the primary winding 4 of a matching transformer 3 is provided with three taps a, b and c. The winding portions between the corresponding taps a, b and c and an opposite terminal d, that is, section windings A, B and C have their impedances selected so as to respectively match with the impedances of the secondary winding 5 and a heating coil (not shown) connected thereto at the frequencies $f_1$, $f_2$ and $f_3$ of three high-frequency electric powers desired for use. The section windings A, B and C are respectively combined with capacitors $A_1$, $B_1$ and $C_1$ so as to form three tank circuits $A$-$A_1$, $B$-$B_1$ and $C$-$C_1$ whose natural frequencies are the frequencies $f_1$, $f_2$ and $f_3$, respectively. In order to switchingly use these tank circuits $A$-$A_1$, $B$-$B_1$ and $C$-$C_1$ as the tuned resonance circuits of the thyristor high-frequency generator 15, the respective tank circuits are switched and connected to the thyristor high-frequency generator 15 proper by appropriate high-speed switching means 6 in the same manner as in the embodiment shown in FIG. 1. Thus, the high-frequency electric powers having the different frequencies $f_1$, $f_2$ and $f_3$ are applied to the heating coil connected to the secondary winding 5 of the matching transformer 3, successively and repeatedly in time-division fashion.

In the power source device of the present invention employing the thyristor high-frequency generator 15 as described above, the trigger circuit 14 which starts the thyristors 10, 11, 12 and 13 in interlocking with the connection switching of the tank circuits adjusts the phases of trigger pulses so as to change the conduction angles of the thyristors, whereby the high-frequency electric powers to be generated at the respective different frequencies can be controlled.

In the embodiment shown in FIG. 2, for the purpose of the permitting the identical power source device to be effectively utilized in a plurality of heat treatment sites existing in remote places, the three tank circuits $A$-$A_1$, $B$-$B_1$ and $C$-$C_1$ formed by the combinations between the respective section windings A, B and C of the primary winding 4 of the matching transformer 3 with the plurality of taps and the corresponding capacitors $A_1$, $B_1$ and $C_1$, and the high-speed switching means 6 for switching and connecting these tank circuits to the thyristor high-frequency generator 15 proper are installed apart from the thyristor high-frequency generator 15 proper and near a high-frequency heating apparatus provided with the heating coil, and the thyristor high-frequency generator 15 proper and the tank circuits are connected by a suitable 2-wire cable.

Figure 3:
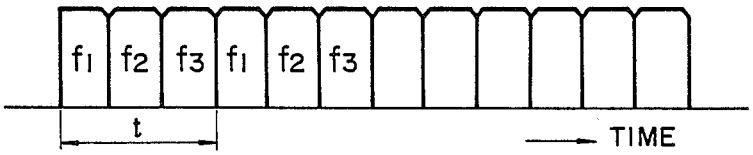
FIG. 3 is a diagram exemplifying the time relationship of the switching of three high-frequency electric powers in the power source device of the present invention for high-frequency induction heating.

FIG. 3 schematically shows by way of example that time relationship of the power source device of the present invention for high-frequency induction heating in which the high-frequency electric powers having the frequencies $f_1$, $f_2$ and $f_3$ are generated by repeating the time-divisional successive switching connections of the tank circuits respectively having the natural frequencies $f_1$, $f_2$ and $f_3$ to the high-frequency power source proper. A time interval t denotes the switching period of the frequencies.

The power source device of the present invention for high-frequency induction heating can generate a plurality of high-frequency electric powers of desired frequencies repeatedly in time-division fashion and in successive switching at a very short switching period. It is accordingly possible to create a heating situation approximate to multiple-frequency simultaneous heating in such a way that the plurality of high-frequency electric powers are supplied to the heating coil of an induction heating apparatus through a matching transformer in time-division fashion and substantially continuously. Accordingly, in case of performing a heat treatment for, for example, the surface quenching of an object to-be-treated which has concave and convex parts and whose shape is complicated, for example, a gear or a screw, the whole object to-be-treated can be homogeneously heated, and uniform quenching can be carried out with an equal quenching depth over the entire surface of the object. As a result, it is possible to achieve useful effects such as an enhanced productivity based on the shortening of a heat treatment process, energy conservation, enhancement in the quality of a product, and rise in a job efficiency.

Further, the power source device of the present invention is structurally simple and is easy of fabrication. Moreover, since the primary winding of the matching transformer forms tank circuits, the power factors thereof are 100%, and separate power-factor adjustment circuits need not be disposed. Since a power source of comparatively small capacity can be used as a self-excited high-frequency power source, the fabrication cost of the power source device can be rendered low.

What is claimed is:

1. A high-frequency induction heating apparatus for induction heating a steel production for surface quenching, said apparatus comprising a heating coil for applying high-frequency power to the surface of said steel product and a self-excited high-frequency power source for supplying high-frequency power to said heating coil, said self-excited high-frequency power source comprising a D.C. source of power, an oscillating element adapted to be energized by said D.C. source of power, a matching transformer having a primary winding and a secondary winding, a plurality of capacitors and high-speed switching means, said heating coil being connected to said secondary winding, said primary winding having a plurality of taps each provided at a position of said primary winding including a different number of turns so as to permit the tapped portions of said primary winding to impedance-match with said secondary winding of said matching transformer and said heating coil connected to said secondary winding at a plurality of frequencies suitable for performing induction heating of said steel product in time-division fashion according to a size, shape and state of said steel product, each of said capacitors being adapted to be combined with a predetermined one of said taps to form a tank circuit for said oscillating element, the natural frequency of which tank circuit is the frequency corresponding to said predetermined tap of said plurality of frequencies, said high-speed switching means being adapted to switch connections of said tank circuits to said oscillating element to perform induction-heating in time-division fashion using high-frequency power at said plurality of frequencies.

2. A high-frequency induction heating apparatus as claimed in claim 1 wherein said apparatus is divided into a first part and a second part, said first part including at least said heating coil, said matching transformer, said plurality of capacitors and said high-speed switching means, said second part including at least said D.C. source of power and said oscillating element, said first part being placed at a first station for performing surface quenching, said second part being placed at a second station remote from said first station, said first station and said second station being connected by a 2-wire cable.

* * * * *